US005224310A

United States Patent [19]

Edwards et al.

[11] Patent Number: 5,224,310

[45] Date of Patent: Jul. 6, 1993

[54] HAND-INSTALLED LANDSCAPE FOUNDATION

[75] Inventors: William G. Edwards; Maynard L. Holdeman, both of Centralia, Mo.

[73] Assignee: A. B. Chance Company, Centralia, Mo.

[21] Appl. No.: 793,583

[22] Filed: Nov. 18, 1991

[51] Int. Cl.[5] ..... E02D 5/80

[52] U.S. Cl. ..... 52/165; 52/157; 52/127.5; 248/156

[58] Field of Search ..... 52/157, 165, 301, 292, 52/DIG. 1, 127.5, 127.7, 153, 154, 296, 297, 298; 248/156, 545

[56] References Cited

U.S. PATENT DOCUMENTS

| | | | |
|---|---|---|---|
| 1,257,215 | 2/1918 | Greene | 248/156 |
| 2,983,345 | 5/1961 | Langer | 52/157 |
| 3,311,333 | 3/1967 | Galloway | 52/296 |
| 3,769,768 | 11/1973 | Bertrand | 52/154 |
| 3,841,032 | 10/1974 | Grannis | 52/169.9 X |
| 4,295,308 | 10/1981 | Korfanta | 52/296 |
| 4,674,907 | 6/1987 | Schewchuk | 52/292 X |
| 4,793,111 | 12/1988 | Schewchuk | 52/298 |
| 5,065,975 | 11/1991 | Giles | 248/545 |

OTHER PUBLICATIONS

Drawing—Type "J" Method of Anchoring Storage and Large Collection Boxes A. B. Chance Company Bulletin-Catalog No. 245A; 24" Anchor Installing Wrench; Bulletin to Postmasters; Letter Box Maintenance.

*Primary Examiner*—Carl D. Friedman
*Assistant Examiner*—Robert J. Canfield
*Attorney, Agent, or Firm*—Hovey, Williams, Timmons & Collins

[57] ABSTRACT

A manually installed landscape foundation (20, 56) adapted for supporting a yard light (22) or similar device requiring connection to a utility line (47) such as an electrical cable or gas line is provided having a lowermost anchor shaft (24, 64) equipped with a load-bearing helix (28, 68) and a slotted, centrally apertured (34, 62) uppermost base plate (30, 58). The anchor shaft (24, 64) is coupled with the base plate (30, 58) so as to define an open clearance area (44, 70) beneath the base plate (30, 58) and aperture (34, 62). A manual driving implement (46, 72) is used for installation purposes, and includes a T-handle (48, 74) having an engagement plate (50, 76) equipped with depending driving lugs (52, 54, 80, 82). In one foundation (20), a bail (36) defining a central clearance area (44) is used to interconnect the anchor shaft (24) and base plate (30). Alternately, in another foundation (56), the anchor shaft (64) is directly coupled in an offset relation to a base plate (58), so as to define a clearance area (70). In the latter embodiment, the driver implement (72) has the T-handle (74) thereof offset relative to the engagement plate (76), and oriented so that the T-handle (74) and anchor shaft (64) are aligned when the driver (72) is operatively coupled with the foundation (56).

10 Claims, 3 Drawing Sheets

HAND-INSTALLED LANDSCAPE FOUNDATION

BACKGROUND OF THE INVENTION

1. Field of the Invention

The present invention is broadly concerned with a manually installable earth anchor foundation of the type useful for supporting landscape items such as lighting fixtures or electrical outlets requiring a utility source, e.g., an electrical cable or gas line. More particularly, it is concerned with a landscape foundation of this type which includes an elongated shaft having a transversely extending load-bearing member such as a helix secured thereto, and operatively coupled to an uppermost, apertured base plate; the anchor shaft and base plate are coupled together by means defining an open clearance area beneath the base plate aperture in order to facilitate placement and threading of an electrical cable or gas line upwardly through the anchor structure.

2. Description of the Prior Art

Helix-type earth anchors have long been employed in a variety of contexts, such as guy line supports, mobile home tie-down systems, or as a part of bases for electrical equipment. Generally speaking, such anchors include an elongated shaft presenting an earth-penetrating tip, together with one or more transversely extending helical blades secured to the shaft along the length thereof. Additionally, structure is provided adjacent the upper ends of the anchor shafts for coupling of a driving element thereto. In the case of large earth anchors of significant length, installation is normally effected by means of a power driven wrench. On the other hand, small earth anchors have in the past been designed for manual installation.

In one specific case, earth anchors have been employed as a part of a hold-down assembly for mailboxes. Such anchors are of the single helix variety and are equipped with an uppermost circular plate having a pair of spaced openings therethrough. A manual driving implement in the form of an upstanding handle having a lowermost plate provided with depending driving lugs is used to engage the upper circular plate of the anchor and, by rotation of the implement, screw the anchor into the earth until the circular plate thereof is substantially at grade. Thereupon, a mailbox leg may be bolted to the circular anchor plate for hold-down purposes.

Anchors of this type are deficient in the context of a landscape foundation, inasmuch as there is no provision for utility service to the supported structure. Moreover, the provision of circular driving/mounting apertures in the uppermost plate of the anchor makes it mandatory that the anchors be rather precisely positioned so as to accommodate the fixed distance between mailbox legs. That is to say, if the anchors are positioned apart even slightly greater or less than the distance between the mailbox legs, then it can be difficult or impossible to properly attach the legs to the respective upper plates of the anchors. As can be appreciated, such precise anchor placement can be especially difficult where the anchors must be manually installed.

SUMMARY OF THE INVENTION

The present invention overcomes the problems outlined above and provides an improved foundation specifically adapted for use as a landscape foundation wherein a supported light or similar article requires utility (e.g., electrical or natural gas) service. Broadly speaking, the foundation of the invention includes an elongated shaft having a transversely extending, load-bearing member such as a helical blade affixed to the shaft, together with a base plate presenting a plurality of elongated slots therein. The base plate also has a central aperture therethrough permitting passage of an electrical cable, gas line or the like through the base plate. The shaft and base plate are operatively coupled by means defining an open clearance area beneath the base plate aperture so that a utility line can readily be threaded beneath the anchor base plate and upwardly therethrough for attachment to a light or other fixture. In addition, use of elongated slots in the base plate allows a significant degree of freedom in attaching the device to be supported by the foundation. Thus, the foundation need not be precisely located as in the case of prior manually installed anchors.

In preferred forms of the invention, the foundation base plate has a total of four slots therein respectively located in the corner regions of the base plate and extending inwardly towards the center thereof; in this embodiment, the base plate aperture is located substantially at the center of the base plate.

In one specific embodiment, the lower foundation shaft is coupled to the base plate by means of an elongated bail presenting a pair of space apart, upright legs secured to the base plate underside. The bail also has a central bight section interconnecting the legs remote from the base plate, with the foundation shaft being affixed to this bight section and extending downwardly therefrom. Thus, the desired clearance opening beneath the base plate is defined by the open region between the bail legs.

In another embodiment, the foundation shaft is directly coupled to the underside of the base plate, but is offset from the center thereof whereby to define an open clearance area directly beneath the base plate and the aperture at the central region thereof.

A driving implement also forms a part of the invention, and is in the form of an elongated handle presenting a lowermost engagement plate having a pair of depending driving lugs. These lugs are oriented for receipt in a pair of the anchor base plate slots, so as to afford a driving connection between the implement and foundation. In the case of the offset shaft anchor described above, the preferred driving implement has a centrally apertured, hexagonal in plan configuration lowermost plate, with an upstanding handle affixed in an offset relation to the lower plate. This driving handle is oriented to align with the offset anchor shaft of the foundation when the driver is operatively coupled with the foundation and the lugs thereof are received in the base plate slots.

DETAILED DESCRIPTION OF THE DRAWINGS

Figure 1:
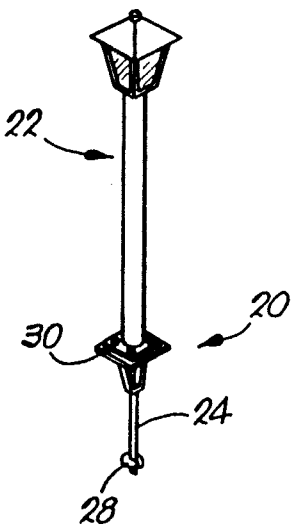
FIG. 1 is an isometric view of a landscape foundation in accordance with the present invention, with a conventional yard light secured to the foundation and supported thereby.
Figure 2:
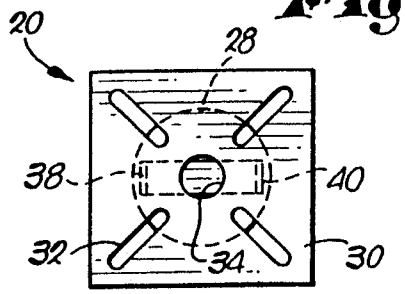
FIG. 2 is a plan view of the foundation depicted in FIG. 1, with the underlying structure of the foundation being shown in phantom.
Figure 3:
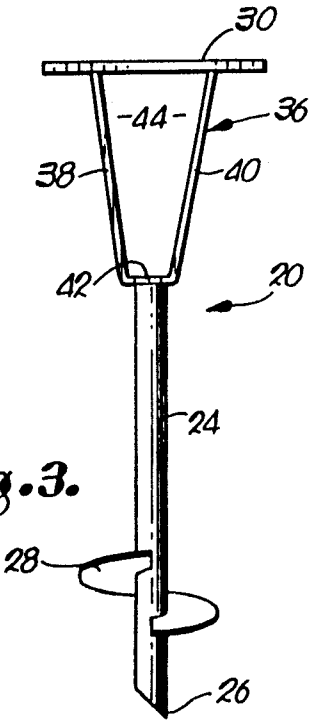
FIG. 3 is a side elevational view of the foundation illustrated in FIG. 2.

Turning now to the drawings, and particularly FIGS. 1–3, a landscape foundation 20 is illustrated. As shown in FIG. 1, the foundation 20 is adapted to support an upright yard light 22 or similar electrically or gas powered unit.

Broadly speaking, the foundation 20 includes a lowermost, elongated metallic solid anchor shaft 24 having an earth-penetrating tip 26 and an outwardly extending helical blade 28. In addition, the foundation includes a base plate 30 which in the form shown is generally square in plan configuration and has a total of four elongated slots 32 therein. As shown, the slots 32 are respectively located in the corner regions of the base plate 30 and extend inwardly toward the center thereof. Furthermore, the base plate has a central aperture 34 therethrough which is sized for passage of a utility line or the like through the base plate.

The base plate and anchor shaft 24 are operatively coupled by means of an elongated bail 36. The latter includes a pair of upstanding, spaced apart legs 38, 40 welded or otherwise affixed to the underside of base plate 30, as well as a bight section 42 interconnecting the legs 38, 40 remote from the base plate 30. The uppermost end of solid shaft 24 is secured to the bight section 42, again by welding or other convenient means. It will be appreciated in this respect that the legs 38, 40 define therebetween the desired clearance area 44 permitting placement of a utility line beneath and upwardly through the base plate.

Figure 4:
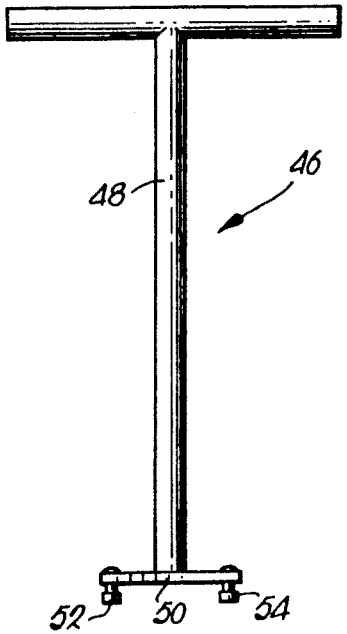
FIG. 4 is a side elevational view of a driver implement for use with the foundation illustrated in FIGS. 2–3.
Figure 5:
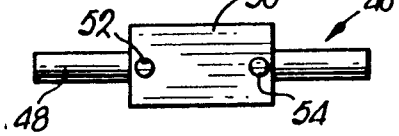
FIG. 5 is a bottom view of the driver depicted in FIG. 4.

FIGS. 4–5 illustrate a driver implement 46 useful for placement of foundation 20. The driver includes an upright T-handle 48 having a laterally extending engagement plate 50 secured to the underside thereof. The latter has a pair of depending spaced apart driving lugs 52, 54 oriented for receipt within a pair of opposed slots 32 provided in base plate 30.

Figure 6:
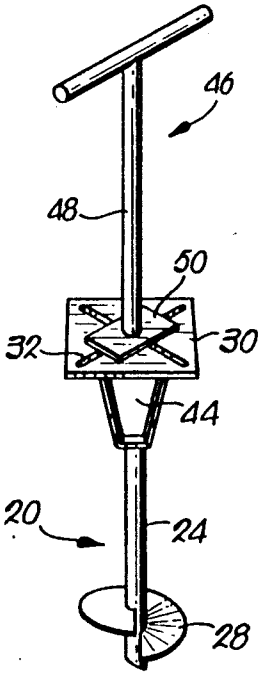
FIG. 6 is an isometric view of the driver of FIGS. 4–5 operatively engaging the foundation of FIGS. 2–3.
Figure 14:
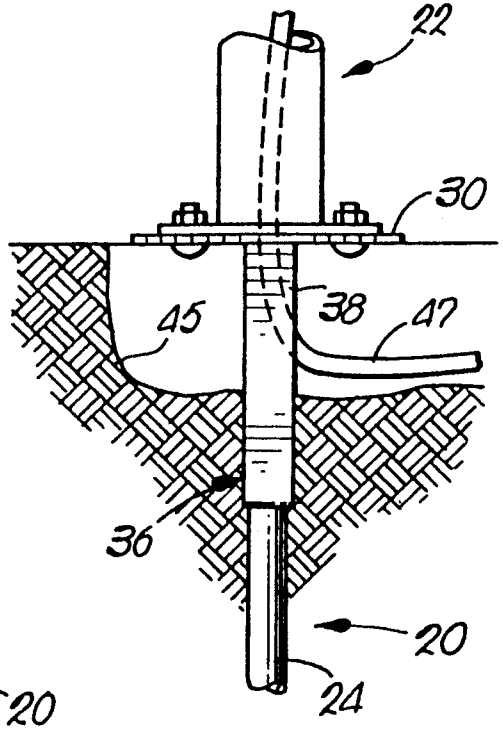
FIG. 14 is a fragmentary side view showing an embedded foundation supporting a landscape device.
Figure 13:
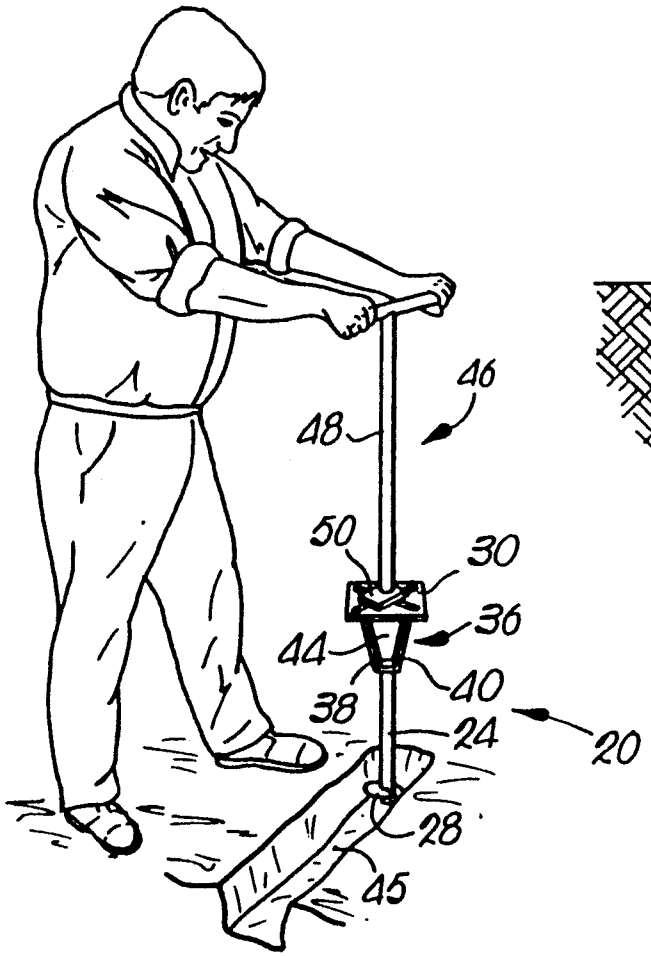
FIG. 13 is an elevational view illustrating the manual installation of a foundation in accordance with the invention.

FIG. 6 illustrates the driver 46 operatively engaged with foundation 20, as would occur during placement of the latter at a desired location in the earth. In this connection, and as best shown in FIGS. 13–14, the foundation 20 would typically be placed within a shallow trench 45 adapted for a utility line, whereupon the driver 46 would be used to manually rotate the foundation 20 into the earth (see FIG. 13) until the base plate 30 thereof is substantially at grade. At this point, the utility line (such as electrical cable 47) within the aforementioned trench 45 would be passed into the clearance area 44 and upwardly through the central aperture 34 into the body of the device to be supported. In the case of an electrical yard light installation as illustrated in FIGS. 1 and 13–14, an electrical cable 47 (see FIG. 14) would be passed upwardly through the standard of yard light 22 and appropriately connected, whereupon the trench 45 would be backfilled and the base of the yard light 22 positioned atop base plate 30 of the foundation. The yard light base would typically be provided with a plurality of mounting apertures, and conventional bolt means would then be employed for securing the yard light base to foundation base plate 30 using the corner slots 32 for this purpose, thus completing the installation.

Figure 7:
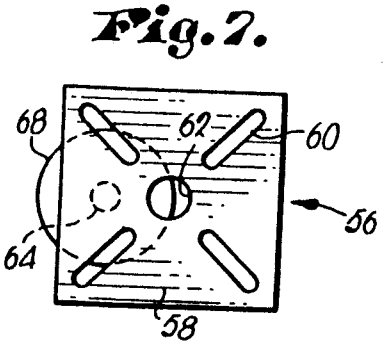
FIG. 7 is a plan view of another embodiment of the invention, illustrating a foundation having an offset, depending anchor shaft.
Figure 8:
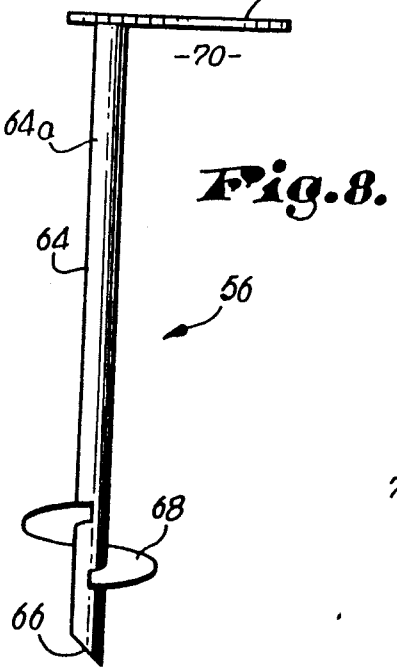
FIG. 8 is an elevational view of the foundation depicted in FIG. 7.

Attention is next directed to FIGS. 7–8 wherein another foundation 56 in accordance with the invention is illustrated. In this case, the foundation 56 includes a base plate 58 again of square plan configuration and having four elongated corner slots 60 therein, as well as central aperture 62. An elongated, depending solid anchor shaft 64, equipped with lead point 66 and load-bearing helix 68, is directly affixed to the underside of base plate 58. As is most apparent from FIG. 8, the uppermost portion 64*a* of shaft 64 is welded or otherwise affixed directly to the underside of base plate 58. However, it will be observed that the solid shaft 64 is offset from the center of the base plate, being located between a pair of adjacent slots 60. In this case, the desired utility line clearance area 70 beneath base plate 58 and aperture 62 is afforded by virtue of the offset location of the entire shaft 64.

Figure 9:
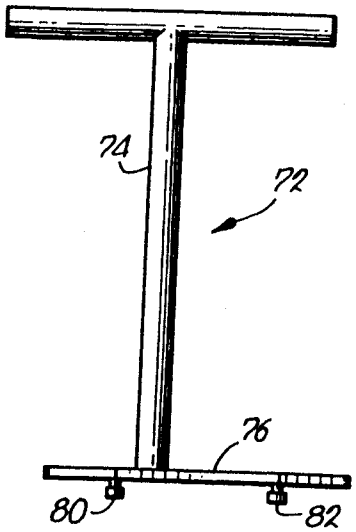
FIG. 9 is a side elevational view of a preferred driving implement for use with the foundation of FIGS. 7–8.
Figure 10:
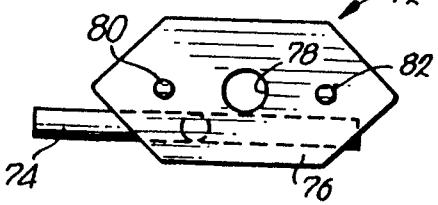
FIG. 10 is a bottom view of the driver shown in FIG. 9.

FIGS. 9–10 depict a driver implement 72 useful for the placement of foundation 56. The implement 72 has T-handle 74 and a lowermost, hexagonal in plan configuration engagement plate 76. The plate 76 is centrally apertured as at 78, and has a pair of spaced apart driving lugs 80, 82 as shown. It will also be seen that the T-handle 74 is mounted in an offset relationship to the plate 76.

Figure 11:
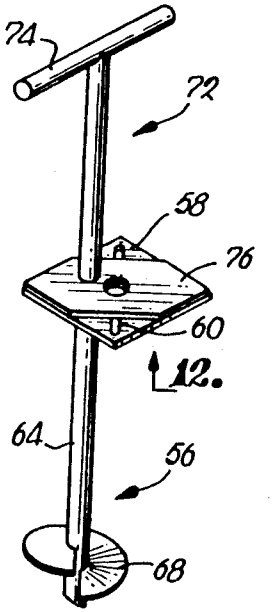
FIG. 11 is an isometric view depicting the driver of FIGS. 9–10 operatively engaging the foundation illustrated in FIGS. 7–8.
Figure 12:
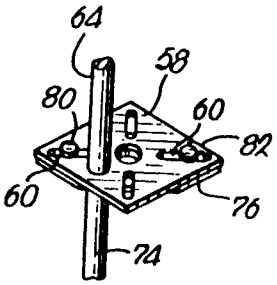
FIG. 12 is a fragmentary bottom view along sight line 12 of FIG. 11 and further illustrating the engagement between the driver and foundation depicted in FIG. 11.

Referring to FIGS. 11–12, the operative interconnection between driver 72 and foundation 56 is illustrated. Thus, the lugs 80, 82 are placed within a pair of opposed base plate slots 60, such that the engagement plate 76 comes into face-to-face contact with base plate 58. In the preferred orientation of the driver 72, the longitudinal axes of anchor shaft 64 and T-handle 74 are substantially aligned. Thus, manual rotation of the T-handle 74 effects corresponding rotation of the foundation 56.

Use of the foundation 56 is very similar to that described with reference to foundation 20. That is, the lead point 66 of the foundation 56 is typically placed within a utility trench, and driver 72 is used to rotate the foundation into the earth until base plate 58 is substantially at grade. Thereupon, a utility line situated within the trench is passed through the clearance area 70 and upwardly through aperture 78 for attachment to a yard light or similar landscape item. Of course, attachment of the landscape item (after the appropriate utility connection is made) is exactly as described with reference to the previous embodiment.

We claim:

1. A foundation comprising:

a single elongated, upright, solid support shaft having a lower portion to which a transverse, outwardly extending, load-bearing helix is affixed;

a base plate transverse to the longitudinal length of the lower portion of the support shaft and having a plurality of elongated slots therein, said base plate further including opposed upper and lower surfaces, and being provided with a central aperture therethrough for passage of a utility line or the like through the base plate; and means operatively coupling said solid support shaft above the lower portion thereof to the lower surface of said base plate and defining an open clearance area beneath said aperture for said line or the like, said coupling means being elongated and extending upwardly from the lower portion of the solid support shaft, there being means for joining said coupling means directly to the lower surface of the base plate at a position beside the aperture therethrough.

2. The foundation of claim 1, said base plate being generally square in plan configuration and having a plurality of elongated driver-receiving slots respectively located in the corner regions of the base plate and extending inwardly towards the center thereof.

3. The foundation of claim 2, said aperture being located at substantially the center of said base plate.

4. The foundation of claim 1, said coupling means comprising an elongated bail presenting a pair of spaced apart, upright legs secured to the lower surface of said base plate and a central bight section interconnecting said legs remote from the base plate, the lower portion of said solid shaft being affixed directly to said bight section and extending downwardly therefrom.

5. The foundation of claim 1, wherein the coupling means joining the lower portion of said shaft to the lower surface of said base plate at a position offset from the center thereof is directly aligned with said lower portion of the shaft whereby the coupling means and said lower portion of the shaft are axially aligned to define said open clearance area beneath said aperture.

6. The foundation of claim 5, said base plate being generally square in plan configuration and having a plurality of elongated driver-receiving slots respectively located in the corner regions of the base plate and extending inwardly towards the center thereof, said offset shaft being located between a pair of adjacent slots.

7. The foundation of claim 6, said aperture being located at substantially the center of said base plate.

8. In combination:

a foundation comprising— a single elongated, upright, solid support shaft having a lower portion to which a transverse, outwardly extending, load bearing helix is affixed;

a base plate transverse to the longitudinal length of the lower portion of the support shaft and having a plurality of elongated slots therein, said base plate further including opposed upper and lower surfaces, and being provided with a central aperture therethrough for passage of a utility line or the like through the base plate;

means operatively coupling said solid support shaft above the lower portion thereof to the lower surface of said base plate and defining an open clearance area beneath said aperture for said line or the like;

said coupling means being elongated and extending upwardly from the lower portion of the solid support shaft, therebeing means for joining said coupling means directly to the lower surface of the base plate at a position beside the aperture therethrough; and a driver adapted for manually rotating said foundation and securing the same in the earth, said driver comprising— a lower engagement plate having a pair of spaced driving lugs depending therefrom and located for insertion into a pair of said base plate slots in order to effect a driving engagement between the engagement plate and base plate; and an upstanding driving handle secured to the upper face of said engagement plate and located in an offset position relative to the center of the engagement plate in substantial alignment with said shaft when said driver is operatively coupled with said foundation with said lugs received within said base plate slots.

9. The combination of claim 8, said driver lower plate having an aperture therethrough oriented for alignment with said base plate aperture when said driver is operatively coupled with said foundation with said lugs received within said base plate slots.

10. The combination of claim 8, said lower plate being hexagonal in plan configuration.

* * * * *